United States Patent [19]

Koster et al.

[11] 4,381,164

[45] Apr. 26, 1983

[54] AMMUNITION TRANSFER SLING AND METHOD OF USING

[75] Inventors: Richard A. Koster; James S. Hoffman, both of York, Pa.

[73] Assignee: Harsco Corporation, Del.

[21] Appl. No.: 290,581

[22] Filed: Aug. 6, 1981

[51] Int. Cl.[3] ..... B66C 1/16

[52] U.S. Cl. ..... 414/416; 53/247; 53/539; 294/87 R; 414/404; 414/786

[58] Field of Search ..... 414/404, 416, 626, 786; 294/87 R, 87.2; 53/247, 539

[56] References Cited

U.S. PATENT DOCUMENTS 1,519,045 12/1924 Panko .
2,372,478 3/1945 Farr et al. ..... 294/87 R
2,784,997 3/1957 Baumann .
3,606,952 9/1971 Mankey .
3,652,117 3/1972 Schroder .
3,780,492 12/1973 Corderoy .

*Primary Examiner*—Robert G. Sheridan
*Attorney, Agent, or Firm*—Kerkam, Stowell, Kondracki & Clarke

[57] ABSTRACT

A hoist includes an upper support plate connected to a lower guide plate by two sliding rods. The hoist is designed for lifting a plurality of elongated articles, such as projectiles, by hooking each article onto a fastener attached to the lower surface of the upper support plate with the article extending through one of several holes in the lower guide plate. The holes in the lower guide plate serve to keep the articles from banging together. Springs may be used to bias the upper support plate towards the lower guide plate. An associated method of using the hoist is especially well-suited for moving projectiles between pallets having different center-to-center or projectile separation distances.

18 Claims, 5 Drawing Figures

AMMUNITION TRANSFER SLING AND METHOD OF USING

BACKGROUND OF THE INVENTION

1. Field of the Invention

The present invention relates to a hoist for moving a plurality of elongated articles. More specifically, the present invention relates to a hoist for transferring a plurality of projectiles from one pallet to a different pallet.

2. Description of the Prior Art

The use of a hoist for moving heavy objects is well known to the prior art. However, such hoists are often difficult to load. Complex mechanisms are sometimes required for securing the object or objects to the hoist. Additionally, the unloading of the hoist may be time consuming or inconvenient. Finally, extra steps and/or complex mechanisms may be required to prevent banging by articles carried on the hoist.

The limitations of prior art hoists, such as conventional platform hoists, is especially evident when attempting to move a plurality of elongated articles from one pallet to another pallet. Usually, such articles must be moved one at a time from the first pallet to the top of a platform on the hoist. The hoist may then be moved adjacent the second pallet. The elongated articles, such as projectiles, may then be moved one at a time from the platform of the hoist to positions on the second pallet. One may readily appreciate the time consuming nature of these series of steps.

Accordingly, it is an object of the present invention to provide a hoist and associated method for simultaneously moving a plurality of like (i.e., similarly constructed) articles without necessitating the loading and unloading of the hoist by one article at a time.

It is a further object of the present invention to provide a hoist and associated method allowing the loading of the hoist without the necessity of moving one of the articles to be lifted prior to securing the articles to the hoist.

A still further object of the present invention is to provide a hoist and associated method for unloading the hoist whereby a plurality of articles may be unloaded from the hoist without lifting the articles from a platform on the hoist.

Yet another object of the present invention is to provide a hoist which will accommodate a plurality of like articles without any banging or other deleterious contact between the articles.

A still further object of the present invention is to provide a hoist and associated method for transferring a plurality of projectiles from a first pallet to a second pallet whereby any change in the center to center distances between the projectiles is readily accomplished.

SUMMARY OF THE INVENTION

These and other objects of the present invention are accomplished by a hoist for lifting a plurality of like articles, the hoist including an upper support plate having an upper surface and a lower surface, a lower guide plate, and a first connector securing the lower guide plate to the upper support plate. The first connector allows movement of the lower guide plate relative to the upper support plate in a direction normal to the lower guide plate. A plurality of holes extend through the lower guide plate and are adapted to accommodate the elongated articles, such as projectiles, which are to be lifted. A plurality of fasteners are mounted on the lower surface of the upper support plate, each fastener preferably including a cable which secures a hook to the upper support plate. The hoist and associated method are especially adapted for transferring a plurality of projectiles from a first pallet to a second pallet, wherein the projectiles have a different center to center distance when disposed on the second pallet as compared to the center to center distance when disposed on the first pallet.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DESCRIPTION OF THE PREFERRED EMBODIMENTS AND METHODS

Figure 1:
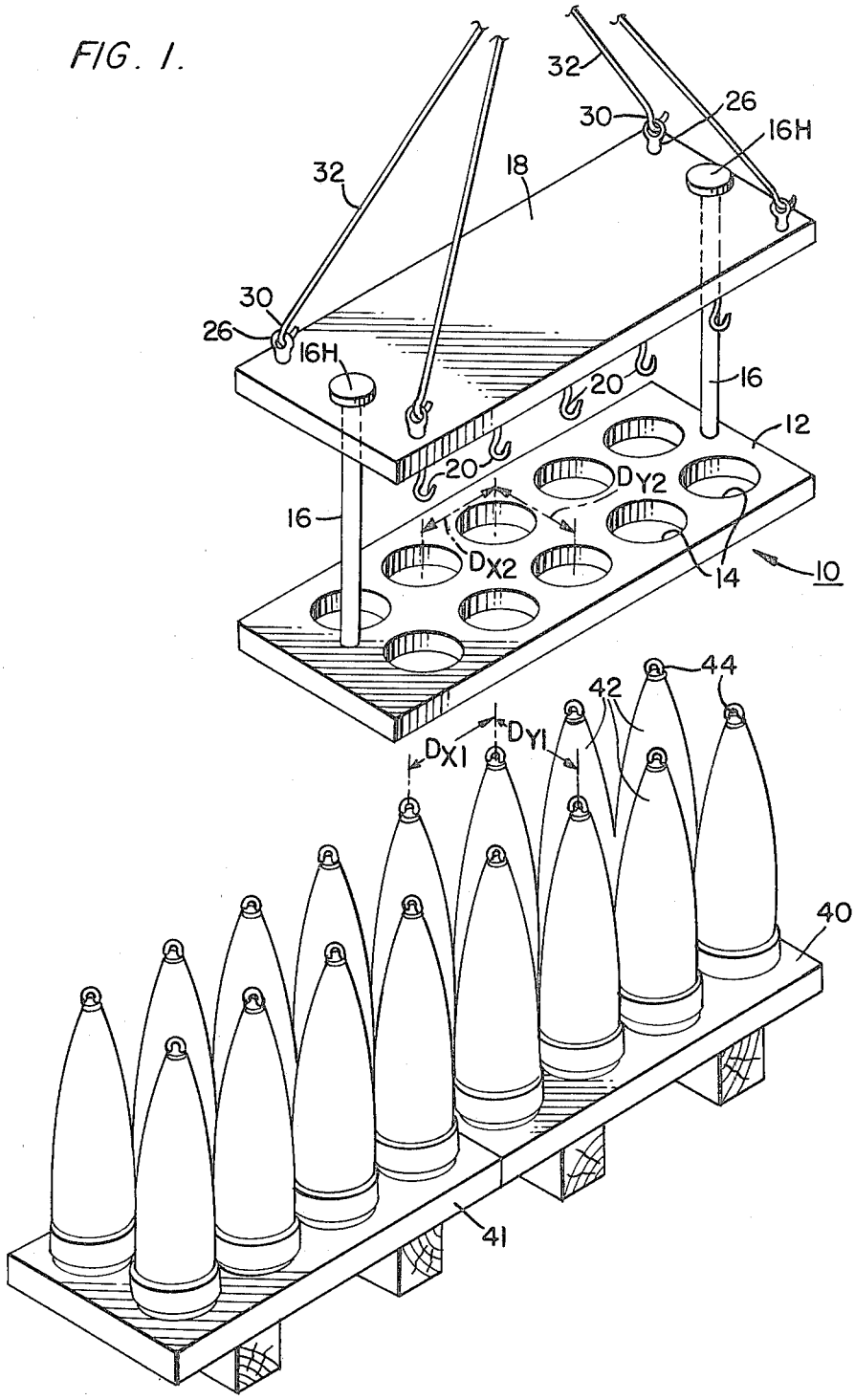
FIG. 1 shows the hoist of the present invention being brought into position for loading the projectiles from a first pallet.

Turning now to FIG. 1, the preferred embodiment of the hoist of the present invention is shown therein. The hoist 10 includes a lower guide plate 12 and an upper support 18. Connectors 16 secure the guide plate 12 to the support plate 18, each connector being a sliding rod fixed to the guide plate 12. The upper ends of each of the sliding rods 16 includes a head 16H which serves as a stop to prevent support plate 18 from sliding off the end of the connector or sliding rod 16. Support plate 18 may freely slide along connector or sliding rod 16 between the heads 16H and the guide plate 12. The guide plate 12 and the support plate 18 are preferably parallel to each other with the sliding rods 16 perpendicularly fixed to the lower guide plate 12. A plurality of holes 14 extend through the guide plate and are adapted to accommodate the articles to be lifted.

Figure 5:
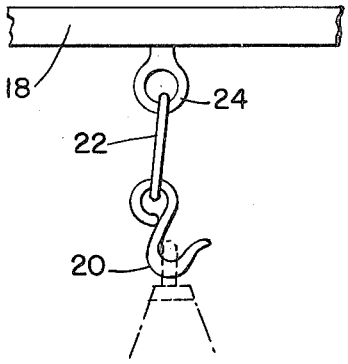
FIG. 5 shows a fragmentary view of a fastener used to secure projectiles to the hoist of the present invention.

Continuing to view FIG. 1, but also considering FIG. 5, the fasteners for the present invention will be described. Specifically, hooks 20 are attached to the lower side of support plate 18 by way of cable 22 and eyebolt 24. For the preferred embodiment shown in the drawings, the underside of support plate 18 would include 10 fasteners arranged in a 2 rows×5 columns configuration. It will be readily appreciated that the back row of fasteners which is not shown in FIG. 1 is the same as the front row of fasteners. Each eyebolt 24 is directly (e.g., perpendicular to guide plate 12) above the center of a corresponding one of holes 14.

Disposed on the upper surface of support plate 18 are a plurality of lifting eyes or eyebolts 26 which may be hooked by hooks 30 attached to lifting cable 32. Lifting cable 32 may be used to lift hoist 10 in a conventional manner.

Figure 2:
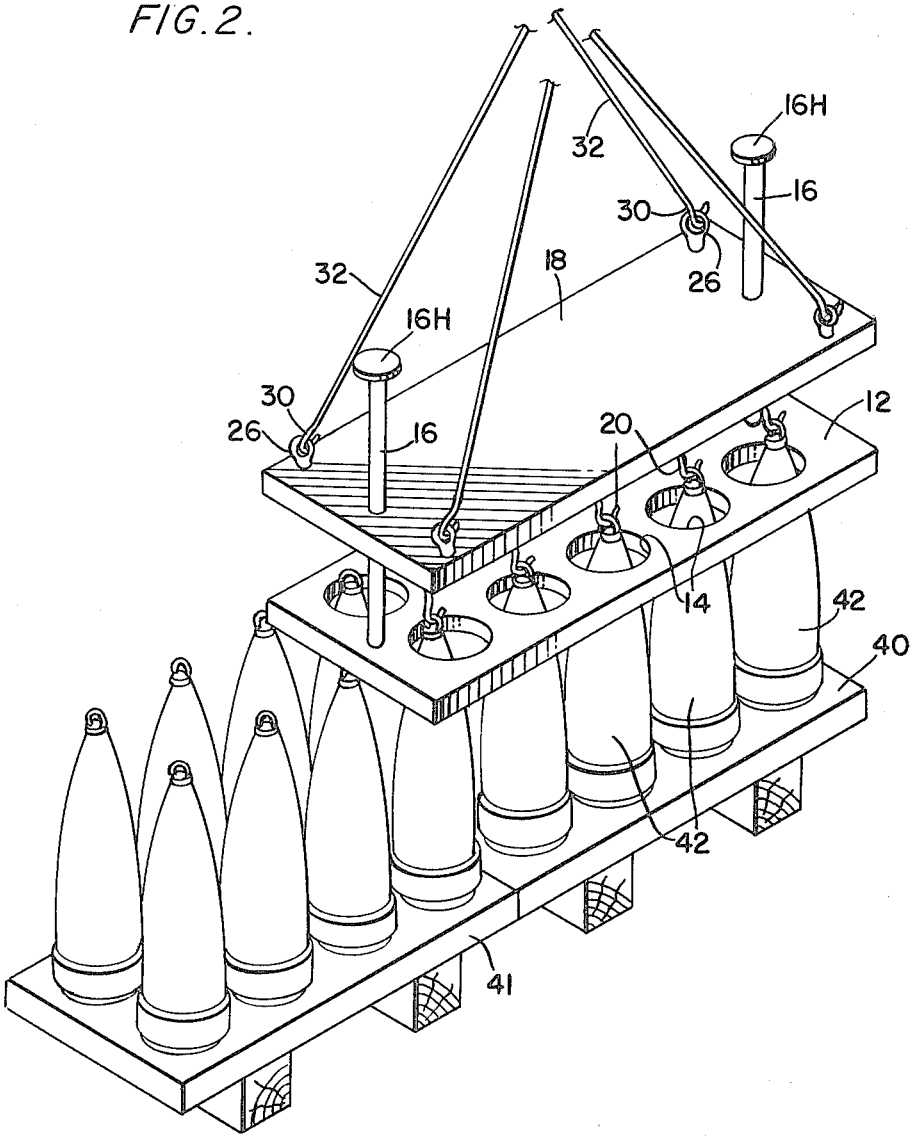
FIG. 2 shows the hoist of the present invention after it has been loaded with the projectiles from a first pallet.

Continuing to view FIG. 1, but also considering FIGS. 2–4, the sequence of operations for using the present hoist 10 will be described in detail. A first pallet 40 contains a plurality of elongate articles such as projectiles 42. Each projectile includes at its nose a catch which is advantageously an eye 44. The projectiles 42 are shown arranged in a two row by four column configuration with a center to center distance (projectile axis to projectile axis) of $D_{x1}$ between any two adjacent projectiles in a row. The center to center distance between any two adjacent projectiles in a column is $D_{y1}$, which may be the same length as $D_{x1}$. Adjacent pallet 40 is another pallet 41 which is preferably identical in construction.

In order to load the hoist 10, the hoist is lowered until each of the projectiles 42 to be moved extends through a corresponding one of the holes 14. Each of the hooks 20 may then be placed through an eye 44. Cable 22 (shown only in FIG. 5) facilitates the hooking of hook 20 onto eye 44. As is especially evident from FIG. 2, sliding rod 16 allows the guide plate 12 to ride up close to support plate 18. Accordingly, hoist 10 need not be positioned precisely in order to allow hook 20 at the end of cable 22 to be attached to the appropriate eye 44 on projectile 42.

Figure 3:
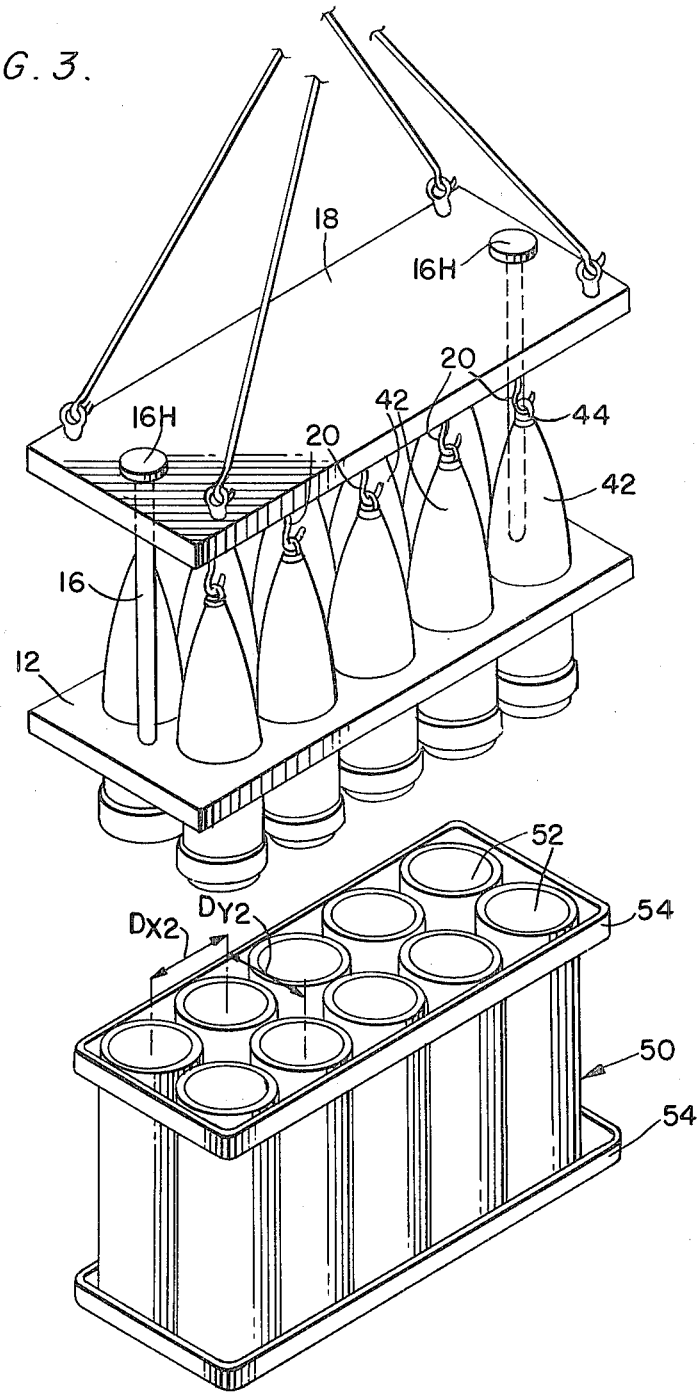
FIG. 3 shows the hoist of the present invention being lowered adjacent a second pallet for unloading the projectiles on the hoist.

Once the hooks 20 are attached to the corresponding eyes 44 on projectiles 42, the hoist 10 may be lifted whereupon gravity and the tendency of each of the cables 22 to straighten out will cause guide plate 12 to drop relative to support plate 18 such that support plate 18 will again be disposed in contact with heads 16h as best shown in FIG. 3. Most advantageously, the guide plate 12 will protect the projectile seals located at the projectile bases by separating the projectiles and preventing banging or other deleterious contact between them. The hoist 10 may be used to move a plurality of the projectiles 42 into a second pallet 50 (FIGS. 3 and 4) having bands 54 and cylindrical tubes 52. If desired, and as shown in FIGS. 3 and 4, the pallet 50 may be that disclosed in Perisastry et al patent application Ser. No. 200,093, filed Oct. 23, 1980, now U.S. Pat. No. 4,344,528, and assigned to the assignee of the present application.

Although the center to center distances $D_{x2}$ between any two adjacent projectiles in a row and $D_{y2}$ between any two adjacent projectiles in a column may be respectively the same as $D_{x1}$ and $D_{y1}$, this is not necessarily the case. Specifically, by placing the eyebolts 24 of the fasteners in a two by five matrix with distances $D_{x2}$ and $D_{y2}$ between adjacent eyebolts in respective rows and columns, the projectiles 42 will automatically be positioned in the appropriate configuration simply by virtue of the operation of the hoist 10 itself. Note that cable 22 (FIG. 5 only) is especially useful in allowing one to fasten hooks 20 onto eyes 44 even if $D_{x2}$ is not the same as $D_{x1}$ and $D_{y2}$ is not the same as $D_{y1}$. The center lines of holes 14 should be disposed with a center to center distance of $D_{x2}$ and $D_{y2}$ (FIG. 1) for the respective rows and columns. The eyebolt 24 (shown only in FIG. 5) will of course be located directly above the center of a corresponding one of the holes 14.

Figure 4:
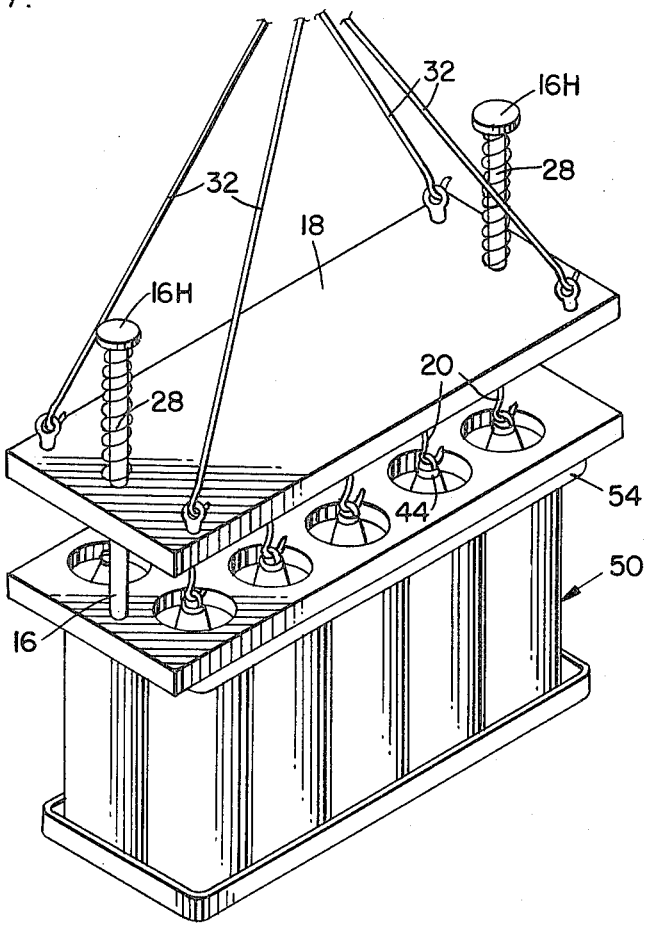
FIG. 4 shows the hoist of the present invention with the projectiles ready for unloading onto the second pallet.

As shown in FIG. 4, the support plate 18 will slide down the sliding rod 16 once the guide plate 12 has made contact with the pallet 50. In the position shown in FIG. 4, the hoist 10 is ready for unloading the projectiles 42 by simply unhooking the hooks 20 from the eyes 44.

As a modification to the present invention, springs 28 (shown only in FIG. 4) may be used to bias support plate 18 towards guide plate 12. When springs 28 are used, the person hooking and unhooking hooks 20 may also pull down on guide plate 12 as the hoist 10 is moved from one pallet to another pallet. Alternately, springs could be used between the guide plate 12 and support 18, which springs are loaded when stretched thereby biasing support plate 18 into guide plate 12. It will be readily appreciated that if the second pallet 50 includes cylindrical tubes 52 as shown, the lowering of hoist 10 to place the projectiles within the cylindrical tubes 52 will be accompanied by the decrease of the distance from the lower guide plate to the upper support plate regardless of whether springs 28 are used. That is, guide plate 12 will sit on the ends of cylindrical tubes 52 while support plate 18 descends to lower the projectiles 42 into the cylindrical tubes 52 even in the absence of springs 28.

It will thus be seen that the present hoist and associated method of using the hoist is simple in construction and convenient in operation. Specifically, the hoist 10 may be loaded without the necessity for first conveying the articles onto the hoist. Likewise, the hoist 10 may be unloaded without conveying, as by carrying, the projectiles off the hoist 10. A simple lowering of the hoist, followed by the hooking or unhooking of hooks 20, is all that is required to load or unload the present hoist. The present hoist and associated method is especially advantageous in that the simple expedient of loading the articles onto the hoist may be used to rearrange the distances between adjacent articles. This feature is especially useful for transferring projectiles between pallets having different center to center distances.

Although the present hoist and associated method has been described in detail by reference to specific embodiments and methods, it is to be understood that the specifics are for illustrative purposes only. Numerous modifications and adaptations will be readily apparent to those of ordinary skill in the art. Accordingly, the scope of the present invention should be determined by reference to the appended claims.

What is claimed is:

1. A hoist for lifting a plurality of like articles comprising:

(a) an upper support plate having an upper surface and a lower surface, (b) a lower guide plate, (c) a first connector securing said lower guide plate to said upper support plate, said first connector allowing movement of said lower guide plate relative to said upper support plate in a direction normal to said lower guide plate, (d) a plurality of holes extending through said lower guide plate adapted to accommodate articles to be lifted, and (e) a plurality of fasteners mounted on the lower surface of said upper support plate, each fastener adapted to be secured to a catch on articles to be lifted, whereby each one of said fasteners may be secured to a catch on an article to be lifted such that the article is raised by the upper support plate by way of the fastener and the article extends through one of said holes in said lower guide plate.

2. The hoist of claim 1 further comprising a second connector securing said lower guide plate to said upper support plate, said second connector allowing movement of said lower guide plate relative to said upper support plate in a direction normal to said lower guide plate.

3. The hoist of claim 2 wherein said first connector is a sliding rod perpendicularly fixed to said lower guide plate, said second connector is a sliding rod perpendicularly fixed to said lower guide plate, and the hoist is adapted for lifting a plurality of vertically disposed like elongate articles.

4. The hoist of claim 3 wherein each of said fasteners includes a cable securing a hook to said upper support plate.

5. The hoist of claim 3 further including a spring biasing said upper support plate and said lower guide plate together.

6. The hoist of claim 1 wherein said hoist is adapted to lift a plurality of projectiles from a pallet with each of said fasteners attaching to a projectile by a catch at the nose of a projectile.

7. The hoist of claim 6 further comprising a second connector securing said lower guide plate to said upper support plate, said second connector allowing movement of said lower guide plate relative to said upper support plate in a direction normal to said lower guide plate, and wherein said first connector is a sliding rod perpendicularly fixed to said lower guide plate and said second connector is a sliding rod perpendicularly fixed to said lower guide plate.

8. The hoist of claim 7 wherein each of said fasteners includes a cable securing a hook to said upper support plate, and each of said fasteners is adapted to attach to an eye serving as the catch at the nose of a projectile.

9. The hoist of claim 8 wherein each of said fasteners is adapted to have its hook catch on one of said eyes.

10. The hoist of claim 9 further including a spring biasing said upper support plate and said lower guide plate together.

11. The hoist of claim 3, 6 or 7 further including a plurality of lifting eyes mounted on said upper surface of said upper support plate, each lifting eye adapted to accommodate a lifting cable.

12. A method of moving a plurality of vertically disposed like elongate articles, the steps comprising:

(a) lowering a hoist having an upper support plate connected to a lower guide plate by at least two sliding rods fixed in a normal position to said lower guide plate, said sliding rods allowing movement of said lower guide plate relative to said upper support plate in a direction normal to said lower guide plate, said hoist being lowered until each of the elongate articles extends through one of a plurality of holes in said lower guide plate, (b) securing a plurality of fasteners mounted on a lower surface of said upper support plate to catches on the elongate articles, and (c) lifting the hoist such that the elongate articles are raised by the upper support plate by way of the fasteners with each of the elongate articles extending through one of said holes in said lower guide plate.

13. The method of claim 12 wherein the lifting of the hoist raises the elongate articles out of a first pallet and further including the step of lowering the hoist to place the elongate articles on a second pallet, the elongate articles having a different center-to-center distance when disposed on said second pallet than when disposed on said first pallet.

14. The method of claim 12 wherein projectiles are the elongate articles which are moved.

15. The method of claim 14 wherein the lifting of the hoist raises the projectiles out of a first pallet and further including the step of lowering the hoist to place the projectiles on a second pallet, the second pallet having the projectiles arranged with a different center-to-center distance than the first pallet.

16. The method of claim 15 wherein the step of lowering the hoist to place the projectiles on a second pallet is accompanied by a decrease in the distance from said lower guide plate to said upper support plate.

17. The method of claim 15 wherein each fastener includes a cable and a hook, each catch is an eye on the nose of the projectile, and the securing of each of the fasteners is accomplished by hooking one of the hooks to one of the eyes.

18. The method of claim 17 wherein the lifting of the hoist is accomplished by raising a lifting cable attached to a plurality of lifting eyes on the upper surface of said upper support plate.

* * * * *